United States Patent [19]

Crowe

[11] Patent Number: 4,828,176

[45] Date of Patent: May 9, 1989

[54] SCENTED BALLOON & VALVE

[75] Inventor: Jonathan M. Crowe, Beaumont, Tex.

[73] Assignee: Scents of Heaven, Inc., Houston, Tex.

[21] Appl. No.: 229,764

[22] Filed: Aug. 4, 1988

Related U.S. Application Data

[63] Continuation of Ser. No. 698,820 Feb. 2, 1985, abandoned.

[51] Int. Cl.[4] ..... A63H 27/10; A61L 9/00

[52] U.S. Cl. ..... 239/60; 239/34; 239/289; 206/0.5; 220/23; 446/222

[58] Field of Search ..... 239/34, 60, 289; 220/23; 206/0.5; 446/220–226, 156; 252/522 R; 63/DIG. 2; 428/9, 12, 905

[56] References Cited

U.S. PATENT DOCUMENTS

| | | | |
|---|---|---|---|
| 1,475,588 | 11/1923 | Lozowsky | 446/224 X |
| 1,974,955 | 9/1934 | Foltis | 239/60 |
| 2,004,295 | 6/1935 | Rothchild et al. | 239/60 |
| 2,436,505 | 2/1948 | Du Rall | 239/33 X |
| 2,618,892 | 11/1952 | Locks et al. | 446/268 |
| 2,922,252 | 1/1960 | Van Dam et al. | 428/12 |
| 2,996,834 | 8/1961 | Berlow | 446/220 |
| 3,791,667 | 2/1974 | Haviland | 446/220 X |
| 4,004,614 | 1/1977 | Mackal et al. | 446/222 |
| 4,155,500 | 5/1979 | Dutcher | 239/59 |
| 4,476,171 | 10/1984 | Takeuchi | 239/60 |
| 4,484,768 | 11/1984 | Norfleet | 239/289 |
| 4,514,423 | 4/1985 | Tezuka et al. | 426/3 |
| 4,556,236 | 12/1985 | Scholz et al. | 280/729 |
| 4,563,161 | 1/1986 | Zimmerman | 446/156 |
| 4,586,456 | 5/1986 | Forward | 446/220 |
| 4,586,910 | 5/1986 | Buchanan | 446/220 |

FOREIGN PATENT DOCUMENTS

| | | | |
|---|---|---|---|
| 2170414 | 8/1986 | United Kingdom | 446/222 |

*Primary Examiner*—Andres Kashnikow
*Assistant Examiner*—Patrick Burkhart
*Attorney, Agent, or Firm*—D. Arlo Groves

[57] ABSTRACT

A valve assembly for use with an inflatable article wherein the valve assembly tends toward greater sealing when the inflatable article is subject to increased pressure and wherein the sealing portion of such assembly is adapted to secure a tablet therein.

13 Claims, 1 Drawing Sheet

SCENTED BALLOON & VALVE

This application is a continuation of application Ser. No. 06/698,820, filed Feb. 2, 1985, now abandoned.

FIELD OF THE INVENTION

The present invention relates generally to scented balloons and to valve assemblies to be inserted into the necks of balloons to emit fragrances, and more particularly to a balloon neck fitting comprising a collar portion adapted to surround the neck of a balloon and an interlocking portion adapted to seal the balloon both when fully inserted and when only partially inserted, and further adapted so as to tend to seal more tightly from either position whenever an inflated balloon is subjected to sudden or increased pressure from external sources.

BACKGROUND OF THE INVENTION

No fragrant balloons or devices adapted for the combined purposes of sealing balloons and permitting the emission of fragrances are known to applicant. Most balloon valves heretofore, whether of the two-piece or one-piece variety, have been of the kind that are inserted into the neck of a balloon, or, more precisely, of the type that requires the usually rather small opening of the balloon to be stretched over the outer body of the valve assembly. In the two-piece variety, sealing is then effected by the insertion of a slidable member such as a plug valve or cap into the receptacle of the valve assembly interior to the balloon neck. In the one-piece variety, the valve means is rigidly attached to the interior portion of the valve assembly, which is usually small enough to be easily swallowed by a child. In the two-piece variety, slidable members such as plug valves, caps and the like have the dual disadvantages of being both small enough to be easily swallowed by children and having the tendency to pop out if the balloons are subjected to a sudden increase in pressure. Additionally, there being merely a frictional engagement between the balloon and the valve assembly itself, the entire valve assembly has a tendency to pop loose from its frictional engagement with the neck of the balloon when subjected to increases in pressure, and, being relatively only little larger than the slidable member, the entire valve assembly is easily swallowed by a child. In addition, neither variety has the means to safely encapsulate a fragrance-carrying medium.

SUMMARY OF THE INVENTION

One object of the present invention is to provide a balloon neck fitting adapted to be fitted exterior to the balloon so as to permit the balloon neck to be readily pulled through such collar portion and to provide a mechanical interlock or fit between the collar, the neck portion of the balloon, and the interlocking member.

Another object of the present invention is to provide a balloon valve assembly with a safety connection between the collar portion and the sealing member.

A further object of the present invention is to provide a balloon valve assembly comprising a collar portion and a sealing member wherein said sealing member tends to move toward a more secure position when subjected to sudden increases in pressure, regardless of whether said sealing member was initially in interlocking engagement with said balloon and collar portion or was initially only partially inserted into said collar portion.

Still another object is to provide valve assembly means adapted so as to safely carry a fragrance-emitting medium and to permit the rapid diffusion of such fragrance; still another object is to provide means for scenting balloon bodies themselves.

DESCRIPTION OF THE PREFERRED EMBODIMENTS

Balloon valve assemblies according to preferred embodiments of the invention will now be described with reference to the drawings.

Figure 1:
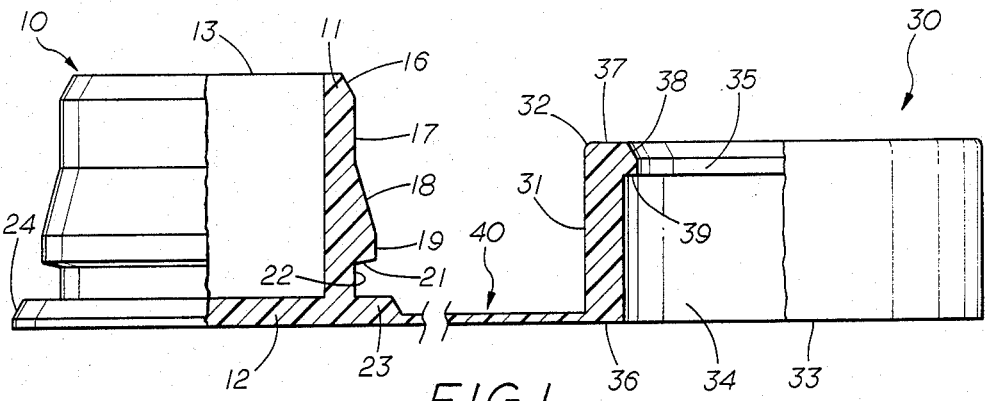
FIG. 1 is a side view of a preferred embodiment of the present invention comprising a neck fitting 10, a collar portion 30, and a connecting member 40. Substantially the left half of neck fitting 10 is shown in section; substantially the right half of collar portion30 is shown in section.
Figure 4:
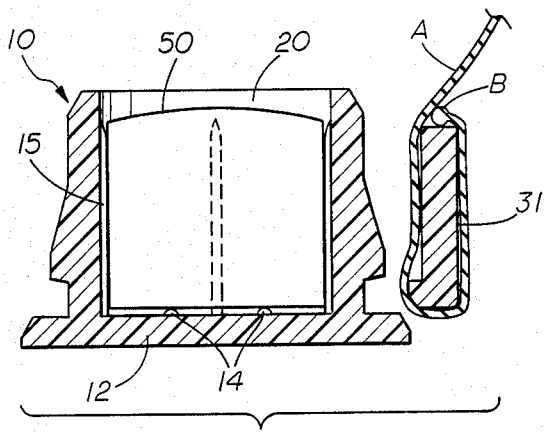
FIG. 4 is a sectional view of the collar portion 30 engaged with the neck fitting 10 and the balloon A wherein said collar portion 30 and balloon A are shown not in actual engagement with said neck fitting but spaced apart transversely therefrom, for purposes of clarity.

As shown in FIG. 1, a balloon valve assembly constructed according to a preferred embodiment of the present invention comprises a neck fitting 10, a collar portion 30, and a connecting member 40. The entire valve assembly may be made of plastic and is designed so as to permit the entire assembly to be cast or formed as a single article in one operation. Neck fitting 10 is substantially cylindrical in this embodiment. The lateral wall 11 of neck fitting 10 has its outer end closed by an outer end cap or plug 12. The inner end 13 of neck fitting 10 is open to the gases interior to balloon A, and the interior of said neck fitting 10 is preferably sized so as to snugly accomodate a fragrance-carrying medium or "pill" therein. Fragrance-carrying media may be conveniently formed into small, cylindrical, solid tablets embued with whatever aromatic fragrances as may be desired. Interior to the end cap 12, as shown in FIG. 4, are a number of raised platforms 14 spaced apart about the center of the interior portion of end cap 12; these raised platforms 14 serve to elevate the fragrance tablet from the interior side of end cap 12 and thereby permit both ends of the fragrance tablet to be exposed to the gases of balloon A. As also shown in FIG. 4, a preferred embodiment provides a plurality of longitudinally oriented ribs 15 spaced apart around the interior circumferential wall portion 20 of neck fitting 10. These longitudinal ribs 15, preferably slightly resilient, serve both to secure the fragrance tablet and to permit the cylindrical wall portion of the fragrance tablet to be exposed to the gases interior to the balloon A. In this manner, then, it is seen that almost the entire surface of the fragrance tablet is exposed to the interior gases while, simultaneously, the tablet is held securely in place. With a fragrance tablet sized smaller in diameter than the smooth portion of interior circumferential wall portion 20 and larger in diameter than an imaginary circle circumscribing the vertical ribs 15, it is found that the fragrance tablet is secured not only frictionally but with a mechanical interfit as well inasmuch as the vertical ribs 15, being preferably only slightly resilient, cause a slight mechanical deformation of the side walls of the fragrance tablet upon insertion. The result is a tablet secured so firmly that it may not be jarred loose under any combination of blows or impulses, or upon explosion of balloon piece A. Once inserted, a fragrance tablet may be removed from the end cap of neck fitting 10 only by physical destruction of the tablet itself; prying with a thin metallic implement such as a knife blade will not pop out the tablet but will result only in the partial destruction of the tablet, the tablet flaking off into a harmless powder whenever contact is made with the prying element. Even with the removal of a portion of the tablet in this manner, the remainder is securely held in place until such remainder is reduced in size such that it is no longer engaged by a plurality of vertical ribs 15.

The preferred design of the exterior portion of lateral walls 11 of neck fitting 10 is as shown in FIG. 1. The first part of the exterior of end portion 13 to engage balloon piece A is provided with a tapered portion 16 for ease of entry into and centering with collar portion 30 and balloon piece A. This tapered portion may conveniently be at an angle of 30 degrees from the exterior of lateral wall 11, but such angle, within reasonable limits, is not considered critical. It is necessary, of course, for such tapered portion 16, and all other portions contacting balloon piece A, to be smoothly finished so as to avoid puncturing or snagging balloon piece A. Continuing longitudinally downward toward end cap 12, it may be seen that the tapered portion 16 of the exterior of lateral wall 11 leads to a first cylindrical wall portion 17. Said first cylindrical wall portion 17 serves to insure that the body of collar portion 30 is substantially centered about neck fitting 10 prior to engagement with first sealing member 18. Said first sealing member 18 preferably comprises an elongated taper on exterior wall portion 11 so as to seal or partially seal upon engagement with collar portion 30 and balloon piece A; additionally, it has been found that, due to the unique design of neck fitting 10 and collar portion 30, the neck fitting 10 containing end cap 12 will not tend to pop out upon impulse once insertion has proceeded to the point at which even a partial seal has been made by engagement with tapered member 18. This surprising result will be described in more detail later.

Continuing longitudinally towards end cap 12, tapered member 18 connects to a second cylindrical wall portion 19 which forms one of a plurality of seals when engaged with collar member 30 and balloon piece A. The lower extremity of said second cylindrical wall portion 19 is formed by the intersection at nearly 90 degrees with a nearly transverse portion which serves as a mechanical locking member 21. Should the angle of such locking member 21 and corresponding angle of the corresponding interlocking member of collar 30 both be 90 degrees, it is virtually impossible to disconnect neck member 10 and collar member 30 without physically destroying one or the other. While this may be desired for some applications, it is deemed preferable for the majority of uses to construct locking member 21 not with a right angle but with a slightly greater angle such as 95 degrees. Such a construction will permit the neck member 10 to be disconnected from collar member 30 by an adult without destruction of either member, but the difficulty required so to do is beyond the capability of small children and of children generally under the age of 12.

Additionally, locking member 21 serves as a second sealing means when engaged with its interlocking corresponding member of collar 30. Locking member 21 connects to a third cylindrical wall member 22 which similarly provides a sealing function.

Projecting radially outward from cylindrical wall member 22 and end cap 12 in the preferred embodiment of FIG. 1 is a peripheral flange 23. Said peripheral flange 23 provides a convenient grasping member when separating a connected unit and is also designed so as to provide a convenient support for attachment of a suction cup (not shown). The outer rim of said peripheral flange 23 is shown with a tapered portion 24 to permit a section cup to be slipped easily over the flange. In this manner, an inflated balloon may be readily attached to any smooth surface, and the enjoyment therefrom may be extended well beyond the normal time required for a lighter-than-air filled balloon to diffuse enough of its gases to cause it to be no longer lighter than air.

Figure 3:
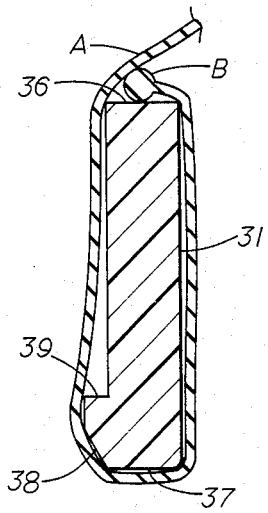
FIG. 3 is a sectional view of a portion of the collar portion 30 with a balloon A inserted therethrough and the mouth B of said balloon A pulled over and encircling said collar portion 30.

Turning now to collar member 30 of FIG.1, it may be seen that the exterior portion 31 of said collar member 30 is substantially cylindrical, the outermost corner 32 thereof being rounded. As shown in FIG. 1, neck member 10 and collar member 30 are oriented as manufactured as a one-piece article. In use, the mouth B of a balloon piece A will be inserted into the collar member 30 from its lower end 33, as oriented in FIG. 1; pulled through the interior portion 34 and the annulus 35, around the exterior portion 31; and placed snugly on the end piece 36. When in place, and prior to being inflated, the balloon piece A will be disposed about the collar member 30 substantially as shown in FIG. 3. To seal the balloon subsequent to inflation, it may be pinched off below the collar member 30 and the neck member 10 may be inserted into collar member 30, the connecting member 40 being flexible enough to permit this operation to be performed quite readily. As is apparent from FIG. 4, it is the upper end 37 of collar member 30, as oriented in FIG. 1, that first engages the neck member 10. To facilitate this initial engagement, the interior portion 38 of end piece 37 is tapered or beveled, preferably at an angle compatible with that of tapered portion 16 of neck member 10. The innermost annulus 35 will form a partial seal when engaged with the smaller portion of the tapered surface 18 of neck member 10, complete seal when engaged with the larger portion of tapered surface 18, and a complete seal with cylindrical wall 22 when completely engaged or "snapped" into place. Also, the transverse portion 39 similarly seals with corresponding surface 21 of neck member 10 when fully engaged; should surface 21 be constructed at an angle greater than 90 degrees, then transverse surface 39 may be formed at the right angle. Conversely, disassembly may also be permitted by constructing surface 21 at the right angle and surface 39 at a slightly greater angle.

Figure 2:
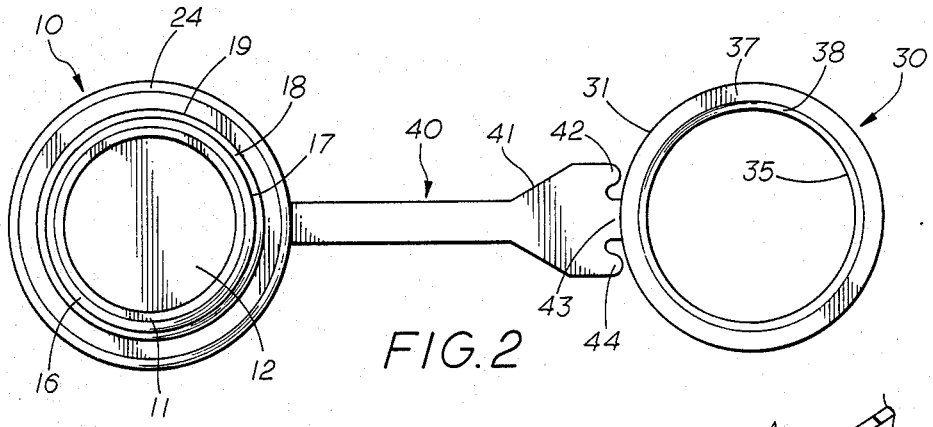
FIG. 2 is a top view of the embodiment shown in FIG. 1.

FIG. 2 shows connecting member 40 preferably formed in a strap-like configuration wherein the end portion 41 which connects to the collar member 30 is flared somewhat hand-like into three "fingers" 42, 43 and 44. Only the middle finger 43 is connected to the collar member 30. The balloon mouth B is prevented by connecting member 40 from completely encircling end piece 36; at the junction thereof with connecting member 40, the mouth B must necessarily rest below connecting member 40. Any tendency of said balloon piece A or mouth B to retract and thus slide off of member 30 may be prevented by the outer fingers 42 and 44. The balloon mouth B may be worked through the spaces between the fingers so as to rest on the side of these fingers opposite to that of the balloon mouth and finger 43. In this configuration, the outer fingers 42 and 44, preferably being constructed of a resilient material, will then urge the balloon mouth B "upward" or outward toward end piece 36, thereby preventing the balloon from disengaging from collar 30. Connecting member 40 thus serves three functions: providing a means for keeping components 10 and 30 together during the manufacturing, distributing, and assemblying operations; increasing the safety of an assembled, inflated unit with respect to small children; and providing a means to keep the balloon mouth engaged with the collar member.

A number of safety features of the present invention has been mentioned, but the most surprising such feature is undoubtedly the tendency of an assembled embodiment to increase the seal between neck and collar when a balloon piece is subjected to sudden increases in pressure. It is well known that the pressure in a gas confined in a container is equal at all points, and that a sudden increase in pressure is transmitted almost instantly throughout the confined volume. It is also apparent that the end cap 12 of neck member 10 is exposed to the gas pressure of the balloon piece, and it is therefore to be expected that an increase in pressure would tend to force the end cap out from collar member 30 and balloon piece A, perhaps even to cause the end cap 12 to be popped free from collar member 30. Such is not the case, however; it has been found and may be readily demonstrated that the tendency of the assembly to move when subjected to increased pressure is in the direction of closure, not in the direction of separation. Further, it has been found-that this tendency is not the result of the interlocking surfaces 21 and 39, but is completely independent of any mechanical interlocking thereof. This latter statement is more easily demonstrable by only partially closing the assembly with an inflated balloon and then subjecting the balloon piece to an increase in pressure, i.e., by inserting neck member 10 into collar member 30 only until the tapered portion 18 of neck 10 is engaged by the innermost annulus 35 of collar 30. At this point, neck member 10 is attached to the assembly only by connecting member 40 and a slight frictional engagement between tapered portion 18, balloon piece A, and surfaces 35 and 38 of collar member 30. The action of connecting strap 40, to the extent it exerts any influence at all on the assembly, is that of an outward force on the neck member 30 as its tendency is to return to its original, unfolded position; thus it is clear that said strap member 40 makes no contribution of forces tending to further close the assembly, and if it contributes any forces at all, it is in the opposite direction, that of opening. Thus for all practical purposes, the engagement of neck member 10 with collar member 30 at this point is frictional only, and with an inclined plane, tapered surface 18, whose incline is such that any compressive force exerted by collar member 30 would be expected to result in a force in the direction of opening rather than in the direction of closing. In fact, the neck member 10 is so loosely held at this point that it may be easily removed by hand. Surprisingly, then, an increase in pressure does not tend to pop out neck member 10 but tends to move collar member 30 further up the inclined plane 18 in the direction of complete closure. In fact, should it be so desired, the inclination of tapered surface 18 may be reduced somewhat from that of the preferred embodiment so that the motion upon reasonable increases in pressure will be sufficient to cause the members 10 and 30 to completely engage, i.e., for the assembly to be self-sealing in the event of incomplete closure and subsequent increased pressure. Applicant prefers, however, to retain a greater inclination such that complete closure will be effected only intentionally and will be indicated positively with an audible "snap". In any event, it is plain that the self-sealing tendency of the present invention is an important safety feature for a device which is intended to be enjoyed by small children, even though the cause thereof may be imperfectly understood.

It is to be understood that the valve assembly of the present invention is gas-tight, or as practically so as may be realized in the real world, and that applicant does not rely upon any leakage around such valve assembly to emit the desired fragrances. Rather, it has been found that the fragrance from the interior of a balloon may be distributed at a satisfactory rate by diffusion through the balloon membrane itself. The present invention, by providing a "child-proof" safety valve and assembly for retention of a fragrance tablet, avoids the safety hazard which would be presented by a fragrance tablet interior to but not secured within a balloon. Alternatively, it has been found that a fragrance-carrying balloon may be created by injecting a fragrance-carrying powder into a finished balloon, or that such a balloon may be created by replacing the normal powder used in the manufacture of balloons with a fragrance-carrying powder. In either event, there is created a balloon with fragrance interior thereto which is not emitted at a rapid rate until subsequent inflation. Still another alternative is the spraying or injection of a liquid-carrying fragrance, but this has been found to be less satisfactory than the other alternatives heretofore described.

Although certain specific embodiments of the invention have been described herein in detail, the invention is not to be limited to only such embodiments, but rather by the appended claims.

What is claimed is:

1. A scented balloon comprising:

(a) a preformed, inflatable balloon, said preformed balloon containing a gas therein and said preformed balloon having a balloon body, a balloon mouth and a balloon neck between said balloon body and said balloon mouth, (b) a non-gaseous fragrance-emitting medium, (c) means for sealing said balloon mouth once said preformed balloon has inflated, (d) means for securing said fragrance-emitting medium to said balloon mouth so as to be in communication with the interior of said balloon body when said balloon mouth has been sealed, (e) said fragrance-emitting medium emitting a fragrance within the interior of said balloon body, (f) said balloon body consisting essentially of a balloon membrane capable of having said fragrance diffuse therethrough, and (g) said fragrance diffusing through said balloon membrane from the interior of said balloon body to the exterior of said balloon body, thereby scenting said balloon body.

2. The scented balloon according to claim 1, wherein said fragrance-emitting medium is a fragrance tablet.

3. The scented balloon according to claim 2, wherein said securing means comprises receptacle means adapted to receive said fragrance tablet in snug engagement therewith with at least one of the surfaces of said tablet being exposed to and thereby in communication with the interior of said balloon body.

4. The scented balloon according to claim 3, wherein said receptacle means comprises a receptacle of substantially similar shape and substantially identical size as said fragrance tablet.

5. The scented balloon according to claim 4, wherein said receptacle further comprises at least one resilient rib on the interior circumference of said receptacle.

6. The scented balloon according to claim 5, wherein said receptacle comprises a plurality of said resilient ribs spaced apart around the interior circumference of said receptacle, thereby exposing additional surface area of said fragrance tablet so as to be in communication with the interior of said balloon body.

7. The scented balloon according to claim 6, wherein said receptacle further comprises at least one platform on the interior end portion of said receptacle.

8. The scented balloon according to claim 7, wherein said receptacle comprises a plurality of said platforms spread apart on the interior end portion of said receptacle, whereby substantially all exterior surfaces of said fragrance tablet are exposed to and thereby in communication with the interior of said balloon body.

9. The scented balloon according to claim 1, wherein said sealing means comprises a balloon valve assembly comprising a neck fitting and a collar portion, said collar portion having an annulus therethrough for receiving said balloon mouth and positioned so as to surround said balloon neck, and said neck fitting being inserted into said balloon mouth and engaging the interior surface of said balloon neck and promoting the sealing engagement of the exterior surface of said balloon neck with the interior annular surface of said collar portion, and promoting sealing engagement of the interior surface of said balloon neck with said neck fitting, thereby sealing said preformed balloon once said neck fitting is inserted.

10. The scented balloon according to claim 9, wherein said sealing means further comprises means for connecting said neck fitting and said collar portion.

11. The scented balloon according to claim 10, wherein said connecting means comprises means for engaging and restraining said balloon mouth.

12. The scented balloon according to claim 9, wherein said sealing means comprises said securing means.

13. A balloon valve assembly comprising:

(a) means for scenting balloon bodies, (b) said scenting means comprising means for securing a fragrance tablet therein, (c) said securing means comprising receptacle means adapted to receive said fragrance tablet in snug engagement therewith, (d) said receptacle means comprising (1) one or more resilient ribs spaced apart around the interior circumference of said receptacle means and (2) one or more platforms spaced apart on the interior end portion of said receptacle means.

* * * * *